US011188005B2

(12) United States Patent
Miyakai et al.

(10) Patent No.: US 11,188,005 B2
(45) Date of Patent: Nov. 30, 2021

(54) LIQUID DEVELOPER

(71) Applicant: CANON KABUSHIKI KAISHA, Tokyo (JP)

(72) Inventors: Tomoyo Miyakai, Tokyo (JP); Yuzo Tokunaga, Chiba (JP); Takashi Hirasa, Moriya (JP); Hayato Ida, Toride (JP); Yasutaka Akashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/017,550

(22) Filed: Sep. 10, 2020

(65) Prior Publication Data

US 2021/0096477 A1 Apr. 1, 2021

(30) Foreign Application Priority Data

Sep. 26, 2019 (JP) ..... JP2019-175900

(51) Int. Cl.
*G03G 9/13* (2006.01)

(52) U.S. Cl.
CPC ..... *G03G 9/131* (2013.01); *G03G 9/132* (2013.01)

(58) Field of Classification Search
CPC ..... G03G 9/131; G03G 9/132
See application file for complete search history.

(56) References Cited

U.S. PATENT DOCUMENTS

| | | | | |
|---|---|---|---|---|
| 9,874,828 | B2 * | 1/2018 | Avigdor | G03G 9/122 |
| 2014/0296385 | A1 * | 10/2014 | Blondel | C08L 77/06 523/439 |
| 2016/0062258 | A1 * | 3/2016 | Cohen | G03G 9/12 430/17 |
| 2018/0074424 | A1 * | 3/2018 | Bar-Haim | G03G 9/135 |
| 2019/0354033 | A1 * | 11/2019 | Kamiyoshi | G03G 7/008 |

FOREIGN PATENT DOCUMENTS

| | | | |
|---|---|---|---|
| JP | 2003-241439 | A | 8/2003 |
| JP | 2010-25971 | A | 2/2010 |
| JP | 2017-49546 | A | 3/2017 |
| JP | 2018-533032 | A | 11/2018 |
| WO | 2006/126566 | A1 | 11/2006 |
| WO | 2007/000974 | A1 | 1/2007 |
| WO | 2007/000975 | A1 | 1/2007 |
| WO | 2007/108485 | A1 | 9/2007 |

* cited by examiner

*Primary Examiner* — Christopher D Rodee
(74) *Attorney, Agent, or Firm* — Canon U.S.A., Inc., IP Division

(57) ABSTRACT

A liquid developer containing toner particles and a carrier liquid, the toner particles containing a resin component, wherein the resin component includes a resin A and a resin B, the resin A has a unit Y1 represented by the formula (1) and a unit Y2 represented by the formula (2), the resin B has a unit Y3 represented by the formula (3) and a unit Y4 selected from the units represented by the formulae (4) to (8), the resin A has a unit Y2 content of 1% to 20% by mass, the resin B has a unit Y3 content of 5% to 90% by mass, the resin component has a resin A content of 50% to 99% by mass, and the resin component has a resin B content of 1% to 50% by mass.

9 Claims, 1 Drawing Sheet

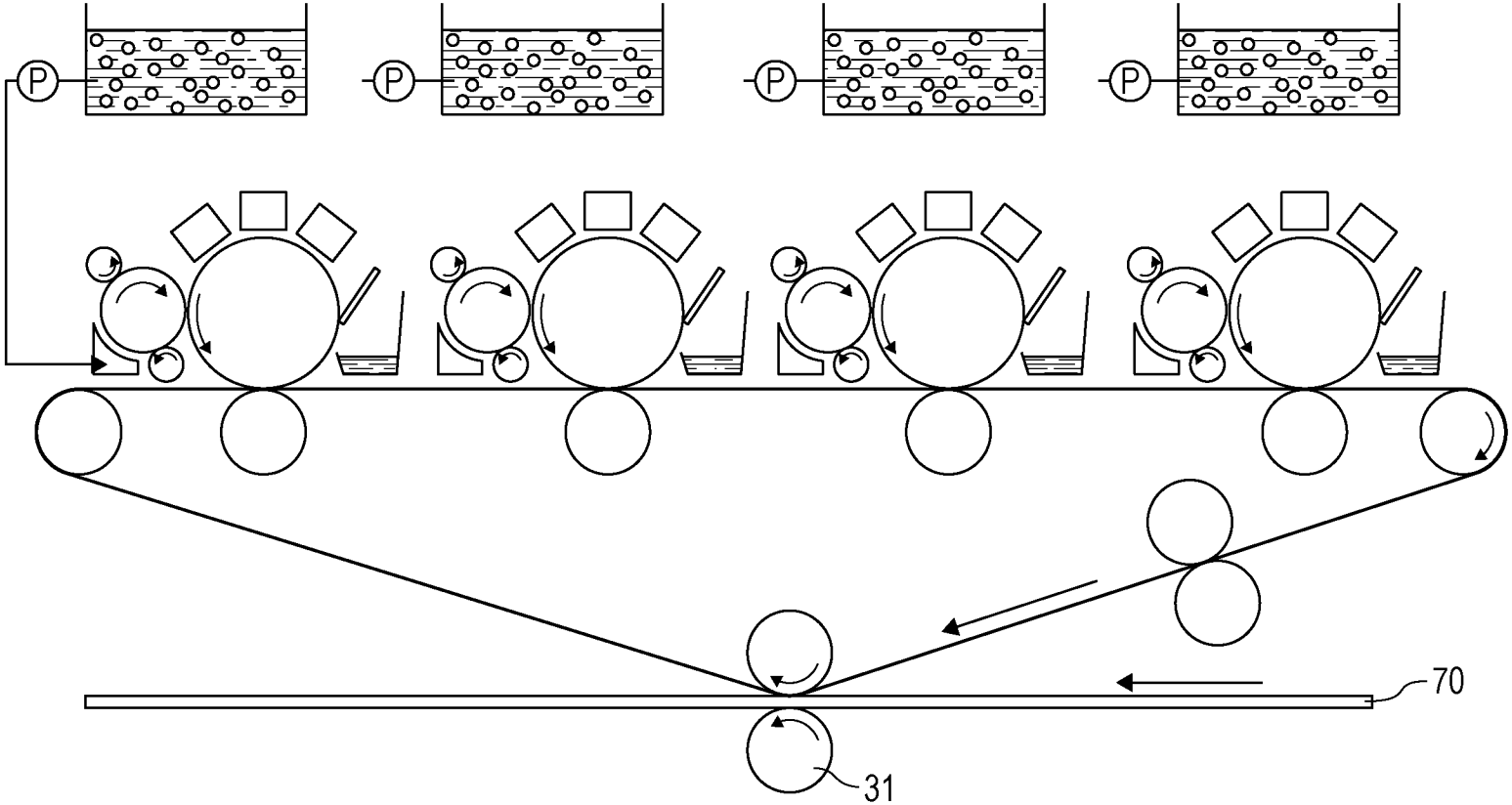
P
P
P
P
70
31

LIQUID DEVELOPER

BACKGROUND OF THE INVENTION

Field of the Invention

The present disclosure relates to a liquid developer for use in an image-forming apparatus that utilizes electrophotography, that is, an electrophotographic apparatus.

Description of the Related Art

In recent years, there has been a growing demand for electrophotographic apparatuses, such as copying machines, facsimile machines, and printers, with improved image quality and with higher speed. In particular, electrophotographic apparatuses that are being actively developed are those using a liquid developer that has good thin line image reproducibility, tone reproducibility, and color reproducibility and that can form an image at high speed. Under such circumstances, there is a demand for a liquid developer with better characteristics.

Liquid developers typically contain toner particles dispersed in a carrier liquid (electrically insulating liquid). A liquid developer is typically fixed by transferring the liquid developer to a recording medium, such as a paper or plastic film, and applying thermal energy to volatilize the carrier liquid and to melt toner particles and fix the toner particles to a recording medium. The carrier liquid is typically an electrically insulating liquid, such as a hydrocarbon organic solvent or silicone oil.

In the flexible packaging market, there has been a growing need for printing on plastic films.

To address the need, PCT Japanese Translation Patent Publication No. 2018-533032 discloses a technique for forming a poly(vinyl alcohol), polyester, polyamine, or polyethyleneimine underlayer on a plastic film to improve adhesion to a toner layer. The plastic film may be formed of polyethylene, polypropylene, polyamide, or poly(ethylene terephthalate).

Japanese Patent Laid-Open No. 2010-25971 discloses a liquid developer containing toner particles that are surface-modified with a polyalkyleneimine. Japanese Patent Laid-Open No. 2017-49546 discloses a liquid developer containing toner particles containing a polyalkylene imine derivative.

Plastic film media for use in flexible packaging include polyethylene, polypropylene, polyamide, and poly(ethylene terephthalate).

When a liquid developer is fixed to these plastic films, particularly a polypropylene film, the fixed image sometimes adheres poorly to the plastic film. Although the adhesion has often been improved by forming an underlayer as described above, this increases the size of the electrophotographic apparatus and increases costs.

Furthermore, the fixing temperature must be lower than the heat resistance temperature of the plastic film, and a liquid developer with low-temperature fixability is required to achieve sufficient fixability.

SUMMARY OF THE INVENTION

The present disclosure provides a liquid developer that can form a fixed image with good low-temperature fixability and with high adhesiveness to a plastic film medium.

The present disclosure provides a liquid developer containing toner particles and a carrier liquid, the toner particles containing a resin component, wherein the resin component includes a resin A and a resin B, the resin A has a unit Y1 represented by formula (1) and a unit Y2 represented by formula (2), the resin B has a unit Y3 represented by formula (3) and at least one unit Y4 selected from the group consisting of units represented by formula (4), units represented by formula (5), units represented by formula (6), units represented by formula (7), and units represented by formula (8), the resin A has a unit Y2 content of 1% to 20% by mass, the resin B has a unit Y3 content of 5% to 90% by mass, the resin component has a resin A content of 50% to 99% by mass, and the resin component has a resin B content of 1% to 50% by mass, (1)

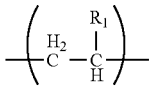

(2)

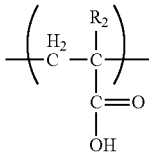

(3)

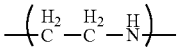

(4)

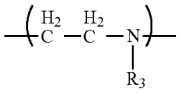

(5)

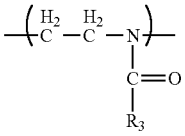

(6)

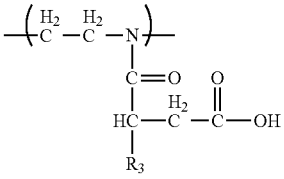

(7)

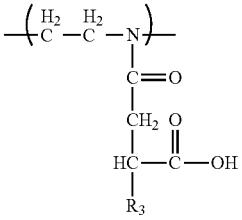

-continued (8)

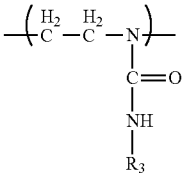

$R_1$ in the formula (1) denotes H or $CH_3$, $R_2$ in the formula (2) denotes H or $CH_3$, and $R_3$ in the formulae (4) to (8) denotes an alkyl group or an alkenyl group.

Further features of the present disclosure will become apparent from the following description of exemplary embodiments with reference to the attached drawing.

BRIEF DESCRIPTION OF THE DRAWINGS

The FIGURE is a schematic view of an electrophotographic apparatus.

DESCRIPTION OF THE EMBODIMENTS

A liquid developer according to the present disclosure contains toner particles and a carrier liquid, the toner particles containing a resin component, the resin component includes a resin A and a resin B, the resin A has a unit Y1 represented by formula (1) and a unit Y2 represented by formula (2), the resin B has a unit Y3 represented by formula (3) and at least one unit Y4 selected from the group consisting of units represented by formula (4), units represented by formula (5), units represented by formula (6), units represented by formula (7), and units represented by formula (8), the resin A has a unit Y2 content of 1% to 20% by mass, the resin B has a unit Y3 content of 5% to 90% by mass, the resin component has a resin A content of 50% to 99% by mass, and the resin component has a resin B content of 1% to 50% by mass, (1)

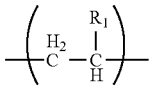

(2)

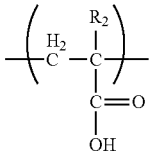

(3)

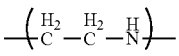

(4)

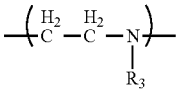

-continued (5)

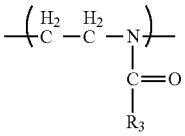

(6)

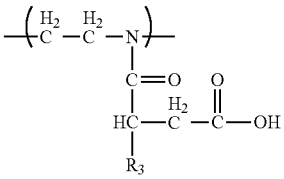

(7)

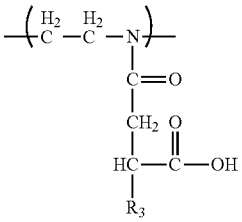

(8)

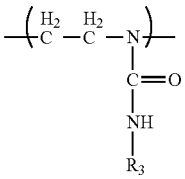

$R_1$ in the formula (1) denotes H or $CH_3$, $R_2$ in the formula (2) denotes H or $CH_3$, and $R_3$ in the formulae (4) to (8) denotes an alkyl group or an alkenyl group. Although the mechanism by which the advantages of the present disclosure are produced is not clear in detail, the present inventors think of the mechanism as described below.

The present inventors found on the basis of study results that although plastic films may have small numbers of surface functional groups, such as a hydroxy group, a carboxy group, and a carbonyl group, the absolute numbers of the surface functional groups are sometimes small. Thus, it is presumed that a chemical interaction between a plastic film and toner particles in a liquid developer is unlikely to occur, and a plastic film with low surface polarity has poor wettability to a liquid developer and causes adhesion problems.

In a liquid developer according to the present disclosure, the unit Y2 in the resin A and the unit Y3 in the resin B have a functional group that can chemically interact with another functional group, such as a carboxy group or an amino group, via an ionic bond, a hydrogen bond, or the like. These functional groups can interact with a surface functional group of a plastic film, such as a polypropylene film. The alkyl or alkenyl chain in the resin B can improve wettability to a plastic film with low polarity, such as a polypropylene film. An amino group in the resin B and a carboxy group in the resin A are bonded together by acid-base interaction and improve the film strength of the fixed image. Due to a high affinity of an alkyl or alkenyl chain in the resin B for the carrier liquid, the toner particles immersed in the carrier liquid swell, and the resin component has a decreased melting point. It is assumed that a unit Y2 content of the resin A, a unit Y3 content of the resin B, and resin A and resin B contents of the resin component within the scope of the present disclosure result in these advantages and high adhesiveness and good low-temperature fixability.

<Toner Particles>

In the present disclosure, toner particles contain a resin component, and the resin component includes a resin A and a resin B.

The resin A has a unit Y1 represented by formula (1) and a unit Y2 represented by formula (2).

(1)

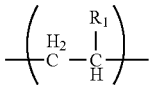

(2)

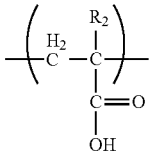

$R_1$ in the formula (1) denotes H or $CH_3$. $R_2$ in the formula (2) denotes H or $CH_3$.

The resin A has a unit Y2 content of 1% to 20% by mass, preferably 5% to 16% by mass. Satisfying these ranges results in a carboxy group content sufficient for interaction with a unit Y3 and with a surface functional group of a plastic film and results in high adhesiveness. A unit Y2 content of 20% or less by mass results in an appropriate affinity for the carrier liquid and good low-temperature fixability.

The resin A may be an ethylene-methacrylic acid copolymer of the unit Y1 represented by the formula (1) and the unit Y2 represented by the formula (2), wherein $R_1$ denotes H, and $R_2$ denotes $CH_3$. The resin A may also be an ethylene-acrylic acid copolymer of the unit Y1 represented by the formula (1) and the unit Y2 represented by the formula (2), wherein $R_1$ denotes H, and $R_2$ denotes H. The resin A may have a unit other than the unit Y1 represented by the formula (1) and the unit Y2 represented by the formula (2).

The resin B has a unit Y3 represented by formula (3) and at least one unit Y4 selected from the group consisting of units represented by formula (4), units represented by formula (5), units represented by formula (6), units represented by formula (7), and units represented by formula (8).

(3)

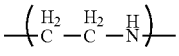

(4)

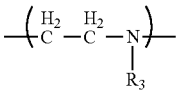

(5)

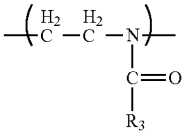

-continued (6)

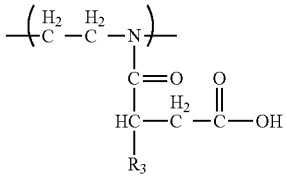

(7)

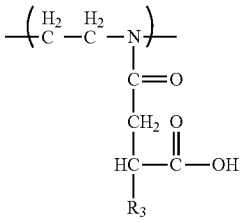

(8)

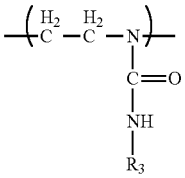

$R_3$ in the formulae (4) to (8) denotes an alkyl group or an alkenyl group. The resin B has a unit Y3 content of 5% to 90% by mass, preferably 5% to 50% by mass. Satisfying these ranges results in an appropriate amount of amino group that contributes to interaction with the unit Y2 and with a surface functional group of a film, an appropriate affinity for the carrier liquid, and high adhesiveness and good low-temperature fixability.

The amount of unit(s) represented by the formula (6) or (7) in the unit Y4 preferably ranges from 50% to 100% by mass in terms of adhesiveness. $R_3$ in the formulae (4) to (8) can denote an alkyl group having 6 to 22 carbon atoms or an alkenyl group having 6 to 22 carbon atoms. $R_3$ being an alkyl group having 6 or more carbon atoms or an alkenyl group having 6 or more carbon atoms results in improved wettability to a plastic film and an improved affinity for the carrier liquid, thus resulting in high adhesiveness and good low-temperature fixability. $R_3$ being an alkyl group having 22 or less carbon atoms or an alkenyl group having 22 or less carbon atoms results in appropriate molecular mobility during storage and during heat fixing, thus resulting in good low-temperature fixability and high storage stability.

The resin B may be produced by a reaction between polyethyleneimine and the following compound:

an alkyl succinic anhydride, an alkenyl succinic anhydride, an alkyl halide, an alkenyl halide, an alkyl isocyanate, an alkenyl isocyanate, an alkyl carboxylic acid, or an alkenyl carboxylic acid.

Among these, succinic anhydrides with an alkyl group having 6 to 22 carbon atoms or with an alkenyl group having 6 to 22 carbon atoms can be used.

The polyethyleneimine may be Epomin SP-003, SP-006, SP-012, SP-018, SP-200, or P-1000 (manufactured by Nippon Shokubai Co., Ltd.).

The resin B can be produced as described below, for example.

Xylene, polyethyleneimine, and the compound to be reacted with the polyethyleneimine are charged into a reaction flask equipped with a thermometer, a stirrer, a nitrogen inlet, a circulator, and a water separator and are heated while stirring. While water is evaporated from the reaction liquid with the separator, and xylene is returned to the reaction liquid, a reaction is performed at high temperature to produce the resin B.

The resin component has a resin A content of 50% to 99% by mass, and the resin component has a resin B content of 1% to 50% by mass. These ranges result in high adhesiveness and good low-temperature fixability. The resin component preferably has a resin A content of 50% to 95% by mass, more preferably 50% to 85% by mass. The resin component preferably has a resin B content of 5% to 50% by mass, more preferably 15% to 50% by mass. These ranges result in higher adhesiveness and better low-temperature fixability.

The resin component can have a unit Y2 content W2 and a unit Y3 content W3 that satisfy $0.10 \leq W2/W3 \leq 4.0$ in terms of adhesiveness.

The structures and amounts of the resin A and the resin B and the structures and amounts of the units Y1 to Y4 in the resin component can be determined by a general analytical method. For example, a Fourier transform nuclear magnetic resonance spectrometer or a gas chromatography-mass spectrometer may be used.

The resin component may include a resin other than the resin A and the resin B.

Examples of the resin other than the resin A and the resin B include homopolymers of styrene and its substitution products, such as polystyrene, poly-p-chlorostyrene, and polyvinyltoluene, styrene copolymers, such as styrene-p-chlorostyrene copolymers, styrene-vinyltoluene copolymers, styrene-vinylnaphthalene copolymers, styrene-acrylate copolymers, styrene-methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; and poly(vinyl chloride), phenolic resins, natural resin modified phenolic resins, natural resin modified maleic acid resins, acrylate resins, methacrylate resins, poly(vinyl acetate), silicone resins, polyester resins, polyester urethane resins, polyurethane resins, polyamide resins, furan resins, epoxy resins, xylene resins, poly(vinyl butyral) resins, terpene resins, coumarone-indene resins, and petroleum resins.

<Carrier Liquid>

A liquid developer according to the present disclosure contains a carrier liquid. The carrier liquid has an electrical insulation property and more specifically has a volume resistivity in the range of $1\times10^9$ to $1\times10^{13}$ Ω·cm. A volume resistivity in this range can result in good development characteristics.

The carrier liquid may be an aliphatic hydrocarbon, such as octane, isooctane, decane, isodecane, decalin, nonane, dodecane, isododecane, Isopar E, Isopar G, Isopar H, Isopar L, Isopar M, or Isopar V (Exxon Mobil Corporation), Shellsol A100 or Shellsol A150 (Shell Chemicals Japan Ltd.), or Moresco White MT-30P (Matsumura Oil Co., Ltd), or silicone oil, such as KF-96L-1.5CS, KF-96L-2CS, or KF-96L-5CS (Shin-Etsu Chemical Co., Ltd.). Among these, aliphatic hydrocarbons can improve adhesiveness and low-temperature fixability.

<Pigment>

In the present disclosure, the toner particles may contain a colorant, such as an organic pigment, an organic dye, an inorganic pigment, a pigment dispersed in an insoluble resin serving as a dispersion medium, or a pigment onto which a resin is grafted.

The following are specific examples of yellow pigments.

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; or C.I. Vat Yellow 1, 3, or 20.

The following are examples of red and magenta pigments.

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, or 269; C.I. Pigment Violet 19; or C.I. Vat Red 1, 2, 10, 13, 15, 23, 29, or 35.

The following are examples of blue and cyan pigments.

C.I. Pigment Blue 2, 3, 15:2, 15:3, 15:4, 16, or 17; C.I. Vat Blue 6; C.I. Pigment Acid Blue 45, or a copper phthalocyanine pigment having 1 to 5 substituted phthalimidemethyl groups on the phthalocyanine skeleton.

The following are examples of green pigments.

C.I. Pigment Green 7, 8, or 36.

The following are examples of orange pigments.

C.I. Pigment Orange 66 or 51.

The following are examples of black pigments.

Carbon black, titanium black, and aniline black.

The following are examples of white pigments.

Basic lead carbonate, zinc oxide, titanium oxide, and strontium titanate.

A pigment may be dispersed in toner particles by a dispersion method suitable for a method for producing toner particles and a liquid developer.

The following are examples of the dispersion method.

A ball mill, a sand mill, an attritor, a rolling mill, a jet mill, a homogenizer, a paint shaker, a kneader, an agitator, a Henschel mixer, a colloid mill, an ultrasonic homogenizer, a pearl mill, and a wet jet mill.

A pigment dispersant may be added to disperse a pigment.

Examples of the pigment dispersant include carboxylates with a hydroxy group, salts of a long-chain polyaminoamide and a high-molecular-weight acid ester, high-molecular-weight polycarboxylic acid salts, high-molecular-weight unsaturated acid esters, high-molecular-weight copolymers, modified polyacrylates, aliphatic polycarboxylic acids, naphthalene sulfonic acid formalin condensates, polyoxyethylene alkyl phosphates, and pigment derivatives. Commercial polymer dispersants, such as Solsperse series manufactured by Lubrizol Corporation, may also be used.

A pigment synergist may be used as a pigment dispersing aid.

The amount of the pigment dispersant and the pigment dispersing aid to be added preferably ranges from 1 to 50 parts by mass per 100 parts by mass of the pigment.

<Other Additive Agents>

A liquid developer according to the present disclosure may contain a charge-controlling agent, if necessary.

The charge-controlling agent may be the following.

Fats and oils, such as linseed oil and soybean oil, alkyd resins, halogen polymers, aromatic polycarboxylic acids, water-soluble dyes with an acidic group, aromatic polyamine oxidation condensates, metallic soaps, such as cobalt naphthenate, nickel naphthenate, iron naphthenate, zinc naphthenate, cobalt octanoate, nickel octanoate, zinc octanoate, cobalt dodecylate, nickel dodecylate, zinc dodecylate, aluminum stearate, and cobalt 2-ethylhexanoate, sulfonic acid metal salts, such as petroleum sulfonic acid metal salts and sulfosuccinate metal salts, phospholipids, such as lecithin and hydrogenated lecithin, alcohol phosphates, such as alcohol phosphonates, salicylic acid metal salts, such as t-butylsalicylic acid metal complexes, polyvinylpyrrolidone resins, polyamide resins, sulfonic acid resins, hydroxybenzoic acid derivatives, etc.

In the present disclosure, the charge-controlling agent content preferably ranges from 0.01 to 10 parts by mass, more preferably 0.05 to 5 parts by mass, per 100 parts by mass of the toner particles (solid content).

A liquid developer according to the present disclosure may contain various additive agents, if necessary, as well as those described above, in order to improve recording medium compatibility, storage stability, image storage stability, or another performance. For example, a filler, an antifoaming agent, an ultraviolet absorber, an antioxidant, an antifading agent, a fungicide, and an anticorrosive may be appropriately selected.

<Method for Producing Toner Particles>

A method for producing a liquid developer according to the present disclosure may be any method, for example, a coacervation method or a wet grinding method.

The coacervation method is described in detail, for example, in Japanese Patent Laid-Open No. 2003-241439, International Publication WO 2007/000974, or International Publication WO 2007/000975.

In the coacervation method, a colorant, a binder resin, a solvent for dissolving the binder resin, and a solvent that does not dissolve the binder resin are mixed, and the solvent for dissolving the binder resin is removed from the liquid mixture to precipitate the dissolved binder resin. Thus, toner particles in which a pigment is embedded can be dispersed in the solvent that does not dissolve the binder resin.

The wet grinding method is described in detail, for example, in International Publication WO 2006/126566 or International Publication WO 2007/108485. In the wet grinding method, a pigment and a binder resin are kneaded at a temperature equal to or higher than the melting point of the binder resin and are dry-ground, and the ground product is wet-ground in a dispersion medium serving as a carrier liquid to produce a liquid developer.

<Method for Measuring Volume-Average Particle Diameter of Toner Particles>

The volume-average particle diameter of toner particles is measured with a laser diffraction/scattering particle size distribution analyzer (trade name: LA-950, manufactured by Horiba, Ltd.).

In the present disclosure, the volume-average particle diameter of toner particles preferably ranges from 0.30 to 1.50 μm.

<Method for Measuring Melt Flow Rate>

The melt flow rate is measured at 190° C. and at a load of 2160 g according to JIS K 7210.

The melt flow rate of a resin component can be controlled by changing the molecular weight of the resin component and can be decreased by increasing the molecular weight.

In the present disclosure, the resin A preferably has a melt flow rate of 500 g/10 min or less in terms of the storage stability of the liquid developer and 5 g/10 min or more in terms of the glossiness of the image.

<Method for Measuring Melting Point>

The melting point can be measured with a differential scanning calorimeter (DSC). More specifically, 0.01 to 0.02 g of a specimen is accurately weighed in an aluminum pan and is heated to a temperature in the range of 0° C. to 200° C. at a heating rate of 10° C./min to obtain a DSC curve.

A peak temperature of an endothermic peak in the DSC curve is taken as a melting point.

In the present disclosure, the resin A can have a melting point, which preferably ranges from 50° C. to 100° C. in terms of low-temperature fixability and storage stability. A melting point of 100° C. or less results in further improved low-temperature fixability. A melting point of 90° C. or less results in still further improved low-temperature fixability. A melting point of less than 50° C. results in poor storage stability.

EXAMPLES

Although a liquid developer according to the present disclosure is more specifically described in the following exemplary embodiments, the present disclosure is not limited to these exemplary embodiments.

Exemplary Embodiment 1

Resin A-1, an ethylene-methacrylic acid copolymer ($R_1$: H, $R_2$: $CH_3$, unit Y2 content: 15% by mass, melt flow rate: 60 g/10 min, melting point: 90° C.) 80 parts Resin B-1, a reaction product between a polyethyleneimine "Epomin SP-012" (manufactured by Nippon Shokubai Co., Ltd.) and dodecylsuccinic anhydride ($R_3$: $C_{12}H_{25}$, unit Y3 content: 20% by mass, total content of unit(s) represented by formula (6) and unit(s) represented by formula (7) in unit Y4: 100% by mass) 120 parts Pigment (Pigment Blue 15:3) 20 parts These materials were well mixed in a Henschel mixer and were melt-kneaded in a co-rotating twin-screw extruder at a roll heating temperature of 100° C. The mixture was cooled and roughly crushed to prepare roughly crushed toner particles.

80 parts of Isopar L (trade name, manufactured by Exxon Mobil Corporation) and 20 parts of the roughly crushed toner particles were then mixed in a sand mill for 36 hours to prepare a toner particle dispersion 1.

The toner particle dispersion 1 was centrifuged, and the supernatant was removed by decantation. The same mass of Isopar L as the supernatant was added to the toner particle dispersion 1, which was then redispersed.

The toner particle dispersion 1 was then mixed with a charge-controlling agent, 0.2 parts of hydrogenated lecithin (Lecinol S-10, manufactured by Nikko Chemicals Co., Ltd.), to prepare a liquid developer 1.

The toner particles in the liquid developer 1 had a volume-average particle diameter of 1.3 μm.

Exemplary Embodiment 2

A liquid developer 2 was prepared in the same manner as in Exemplary Embodiment 1 except that the resin B-1 was replaced with a resin B-2, a reaction product between the polyethyleneimine "Epomin SP-012" (manufactured by Nippon Shokubai Co., Ltd.) and 1-chlorododecane ($R_3$: $C_{12}H_{25}$, unit Y3 content: 20% by mass, total content of unit(s) represented by formula (6) and unit(s) represented by formula (7) in unit Y4: 0% by mass). The toner particles in the liquid developer 2 had a volume-average particle diameter of 1.2 μm.

Exemplary Embodiment 3

A liquid developer 3 was prepared in the same manner as in Exemplary Embodiment 1 except that the resin B-1 was replaced with a resin B-3, a reaction product between the polyethyleneimine "Epomin SP-012" (manufactured by Nippon Shokubai Co., Ltd.) and lauric acid ($R_3$: $C_{11}H_{23}$, unit Y3 content: 20% by mass, total content of unit(s) represented by formula (6) and unit(s) represented by formula (7) in unit Y4: 0% by mass). The toner particles in the liquid developer 3 had a volume-average particle diameter of 1.2 μm.

Exemplary Embodiment 4

A liquid developer 4 was prepared in the same manner as in Exemplary Embodiment 1 except that the resin B-1 was replaced with a resin B-4, a reaction product between the polyethyleneimine "Epomin SP-012" (manufactured by Nippon Shokubai Co., Ltd.) and dodecyl isocyanate ($R_3$: $C_{12}H_{24}$, unit Y3 content: 20% by mass, total content of unit(s) represented by formula (6) and unit(s) represented by formula (7) in unit Y4: 0% by mass). The toner particles in the liquid developer 4 had a volume-average particle diameter of 1.3 μm.

Exemplary Embodiment 5

A liquid developer 5 was prepared in the same manner as in Exemplary Embodiment 1 except that the resin B-1 was replaced with a resin B-5, a reaction product between the polyethyleneimine "Epomin SP-012" (manufactured by Nippon Shokubai Co., Ltd.) and 2-hexen-1-yl succinic anhydride ($R_3$: $C_6H_{13}$, unit Y3 content: 20% by mass, total content of unit(s) represented by formula (6) and unit(s) represented by formula (7) in unit Y4: 100% by mass). The toner particles in the liquid developer 5 had a volume-average particle diameter of 1.3 μm.

Exemplary Embodiment 6

A liquid developer 6 was prepared in the same manner as in Exemplary Embodiment 1 except that the resin B-1 was replaced with a resin B-6, a reaction product between the polyethyleneimine "Epomin SP-012" (manufactured by Nippon Shokubai Co., Ltd.) and butylsuccinic anhydride ($R_3$: $C_4H_9$, unit Y3 content: 20% by mass, total content of unit(s) represented by formula (6) and unit(s) represented by formula (7) in unit Y4: 100% by mass). The toner particles in the liquid developer 6 had a volume-average particle diameter of 1.3 μm.

Exemplary Embodiment 7

A liquid developer 7 was prepared in the same manner as in Exemplary Embodiment 1 except that the resin B-1 was replaced with a resin B-7, a reaction product between the polyethyleneimine "Epomin SP-012" (manufactured by Nippon Shokubai Co., Ltd.) and behenic acid ($R_3$: $C_{21}H_{43}$, unit Y3 content: 20% by mass, total content of unit(s) represented by formula (6) and unit(s) represented by formula (7) in unit Y4: 0% by mass). The toner particles in the liquid developer 7 had a volume-average particle diameter of 1.4 μm.

Exemplary Embodiment 8

A liquid developer 8 was prepared in the same manner as in Exemplary Embodiment 1 except that the resin B-1 was replaced with a resin B-8, a reaction product between the polyethyleneimine "Epomin SP-012" (manufactured by Nippon Shokubai Co., Ltd.) and hexacosanoic acid ($R_3$: $C_{25}H_{51}$, unit Y3 content: 20% by mass, total content of unit(s) represented by formula (6) and unit(s) represented by formula (7) in unit Y4: 0% by mass). The toner particles in the liquid developer 8 had a volume-average particle diameter of 1.5 μm.

Exemplary Embodiment 9

A liquid developer 9 was prepared in the same manner as in Exemplary Embodiment 1 except that the resin B-1 was replaced with a resin B-9, a reaction product between the polyethyleneimine "Epomin SP-012" (manufactured by Nippon Shokubai Co., Ltd.), dodecylsuccinic anhydride, and stearic acid ($R_3$: $C_{12}H_{25}$, $C_{18}H_{37}$, unit Y3 content: 20% by mass, total content of unit(s) represented by formula (6) and unit(s) represented by formula (7) in unit Y4: 50% by mass). The toner particles in the liquid developer 9 had a volume-average particle diameter of 1.3 μm.

Exemplary Embodiment 10

A liquid developer 10 was prepared in the same manner as in Exemplary Embodiment 1 except that the resin B-1 was replaced with a resin B-10, a reaction product between the polyethyleneimine "Epomin SP-012" (manufactured by Nippon Shokubai Co., Ltd.), dodecylsuccinic anhydride, and stearic acid ($R_3$: $C_{12}H_{25}$, $C_{18}H_{37}$, unit Y3 content: 20% by mass, total content of unit(s) represented by formula (6) and unit(s) represented by formula (7) in unit Y4: 40% by mass). The toner particles in the liquid developer 10 had a volume-average particle diameter of 1.3 μm.

Exemplary Embodiment 11

A liquid developer 11 was prepared in the same manner as in Exemplary Embodiment 1 except that the resin A-1 was replaced with 60 parts of a resin A-2, an ethylene-methacrylic acid copolymer ($R_1$: H, $R_2$: $CH_3$, unit Y2 content: 10% by mass, melt flow rate: 500 g/10 min, melting point: 95° C.), and the resin B-1 was replaced with 40 parts of a resin B-11, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 80% by mass, total content of unit(s) represented by formula (6) and unit(s) represented by formula (7) in unit Y4: 100% by mass). The toner particles in the liquid developer 11 had a volume-average particle diameter of 1.2 μm.

Exemplary Embodiment 12

A liquid developer 12 was prepared in the same manner as in Exemplary Embodiment 1 except that the resin A-1 was replaced with 60 parts of a resin A-3, an ethylene-methacrylic acid copolymer ($R_1$: H, $R_2$: $CH_3$, unit Y2 content: 5% by mass, melt flow rate: 33 g/10 min, melting point: 95° C.), and the resin B-1 was replaced with 40 parts of the resin B-11. The toner particles in the liquid developer 12 had a volume-average particle diameter of 1.3 μm.

Exemplary Embodiment 13

A liquid developer 13 was prepared in the same manner as in Exemplary Embodiment 1 except that the resin A-1 was replaced with 88 parts of the resin A-2, and 12 parts of the resin B-1 was used. The toner particles in the liquid developer 13 had a volume-average particle diameter of 1.3 μm.

Exemplary Embodiment 14

A liquid developer 14 was prepared in the same manner as in Exemplary Embodiment 1 except that the resin B-1 was replaced with a resin B-12, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 10% by mass, total content of unit(s) represented by formula (6) and unit(s) represented by formula (7) in unit Y4: 100% by mass). The toner particles in the liquid developer 14 had a volume-average particle diameter of 1.2 μm.

Exemplary Embodiment 15

A liquid developer 15 was prepared in the same manner as in Exemplary Embodiment 1 except that the resin A-1 was replaced with 97 parts of the resin A-2, and 3 parts of the resin B-1 was used. The toner particles in the liquid developer 15 had a volume-average particle diameter of 1.2 μm.

Exemplary Embodiment 16

A liquid developer 16 was prepared in the same manner as in Exemplary Embodiment 1 except that the resin B-1 was replaced with a resin B-13, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 45% by mass, total content of unit(s) represented by formula (6) and unit(s) represented by formula (7) in unit Y4: 100% by mass). The toner particles in the liquid developer 16 had a volume-average particle diameter of 1.3 μm.

Exemplary Embodiment 17

A liquid developer 17 was prepared in the same manner as in Exemplary Embodiment 1 except that the resin B-1 was replaced with a resin B-14, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 60% by mass, total content of unit(s) represented by formula (6) and unit(s) represented by formula (7) in unit Y4: 100% by mass). The toner particles in the liquid developer 17 had a volume-average particle diameter of 1.4 μm.

Exemplary Embodiment 18

A liquid developer 18 was prepared in the same manner as in Exemplary Embodiment 1 except that the resin A-1 was replaced with the resin A-3. The toner particles in the liquid developer 18 had a volume-average particle diameter of 1.3 μm.

Exemplary Embodiment 19

A liquid developer 19 was prepared in the same manner as in Exemplary Embodiment 1 except that the resin A-1 was replaced with a resin A-4, an ethylene-methacrylic acid copolymer ($R_1$: H, $R_2$: $CH_3$, unit Y2 content: 2% by mass, melt flow rate: 130 g/10 min, melting point: 88° C.). The toner particles in the liquid developer 19 had a volume-average particle diameter of 1.4 μm.

Exemplary Embodiment 20

A liquid developer 20 was prepared in the same manner as in Exemplary Embodiment 1 except that the resin A-1 was replaced with a resin A-5, an ethylene-methacrylic acid copolymer ($R_1$: H, $R_2$: $CH_3$, unit Y2 content: 20% by mass, melt flow rate: 60 g/10 min, melting point: 87° C.). The toner particles in the liquid developer 20 had a volume-average particle diameter of 1.3 μm.

Exemplary Embodiment 21

A liquid developer 21 was prepared in the same manner as in Exemplary Embodiment 1 except that Isopar L was replaced with a silicone oil KF-96L-1.5CS (manufactured by Shin-Etsu Chemical Co., Ltd.). The toner particles in the liquid developer 21 had a volume-average particle diameter of 1.4 μm.

Exemplary Embodiment 22

A liquid developer 22 was prepared in the same manner as in Exemplary Embodiment 1 except that the resin B-1 was replaced with a resin B-15, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 6% by mass, total content of unit(s) represented by formula (6) and unit(s) represented by formula (7) in unit Y4: 100% by mass). The toner particles in the liquid developer 22 had a volume-average particle diameter of 1.3 μm.

Exemplary Embodiment 23

A liquid developer 23 was prepared in the same manner as in Exemplary Embodiment 1 except that 55 parts of the resin A-1 and 45 parts of the resin B-1 were used. The toner particles in the liquid developer 23 had a volume-average particle diameter of 1.4 μm.

Exemplary Embodiment 24

A liquid developer 24 was prepared in the same manner as in Exemplary Embodiment 1 except that the resin B-1 was replaced with a resin B-16, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 90% by mass, total content of unit(s) represented by formula (6) and unit(s) represented by formula (7) in unit Y4: 100% by mass). The toner particles in the liquid developer 24 had a volume-average particle diameter of 1.3 μm.

Comparative Example 1

A liquid developer 25 was prepared in the same manner as in Exemplary Embodiment 1 except that the resin A-1 was replaced with an ethylene-ethyl acrylate copolymer EEA-1 (amount of unit derived from ethyl acrylate: 25% by mass, melt flow rate: 20 g/10 min, melting point: 91° C.). The toner particles in the liquid developer 25 had a volume-average particle diameter of 1.4 μm.

Comparative Example 2

A liquid developer 26 was prepared in the same manner as in Exemplary Embodiment 1 except that the resin A-1 was replaced with an ethylene-methacrylic acid copolymer EMA-1 (amount of unit derived from methacrylic acid: 25% by mass, melt flow rate: 70 g/10 min, melting point: 86° C.). The toner particles in the liquid developer 26 had a volume-average particle diameter of 1.3 μm.

Comparative Example 3

A liquid developer 27 was prepared in the same manner as in Exemplary Embodiment 1 except that the resin B-1 was replaced with a resin B-17, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 3% by mass, total content of unit(s) represented by formula (6) and unit(s) represented by formula (7) in unit Y4: 100% by mass). The toner particles in the liquid developer 27 had a volume-average particle diameter of 1.2 μm.

Comparative Example 4

A liquid developer 28 was prepared in the same manner as in Exemplary Embodiment 1 except that the resin B-1 was replaced with a resin B-18, a reaction product between the polyethyleneimine "Epomin SP-012" (manufactured by Nippon Shokubai Co., Ltd.) and dodecylsuccinic anhydride ($R_3$: $C_{12}H_{25}$, unit Y3 content: 95% by mass, total content of unit(s) represented by formula (6) and unit(s) represented by formula (7) in unit Y4: 100% by mass). The toner particles in the liquid developer 28 had a volume-average particle diameter of 1.3 μm.

Comparative Example 5

A liquid developer 29 was prepared in the same manner as in Exemplary Embodiment 1 except that 40 parts of the resin A-1 and 60 parts of the resin B-1 were used. The toner particles in the liquid developer 29 had a volume-average particle diameter of 1.4 μm.

Comparative Example 6

A liquid developer 30 was prepared in the same manner as in Exemplary Embodiment 1 except that 99.5 parts of the resin A-1 and 0.5 parts of the resin B-1 were used. The toner particles in the liquid developer 30 had a volume-average particle diameter of 1.2 μm.

<Evaluation of Adhesion>

An electrophotographic apparatus illustrated in FIGURE adapted for monochromatic development was used for evaluation.

A 50 mm×50 mm patch was drawn with the liquid developer 1 on a recording medium 70, which was a plastic media OPP film (Pylen P2161, manufactured by Toyobo Co., Ltd.).

The recording medium 70 was subjected to corona treatment with a corotron corona charger (not shown) before image transfer.

The bias conditions were set such that the image density was 1.5.

A secondary transfer roller 31 was heated, and drying of the carrier liquid and heat-fixing of the toner were performed at a set temperature of 110° C. and at a process speed of 2 m/s.

The image density was measured with an X-Rite color reflection densitometer (manufactured by X-Rite Inc., X-rite 500 Series).

The adhesion of the fixed image was evaluated by a cross-cut test according to JIS K 5600 Testing methods for paints.

Six grid-like cuts were made in the fixed image at intervals of 2 mm to form 25 squares in a grid pattern.

Cellotape (registered trademark) (Nichiban No. 405) was forcefully applied over the cuts and was removed at an angle of 45 degrees. The grid pattern was examined.

Peeling was not observed in the OPP film, which was rated A according to the following evaluation criteria.

Evaluation Criteria for Adhesion

A: No square in the grid pattern was peeled off.

B: Although the image was slightly peeled off at a cut intersection, the peeled area was not more than 5% by area.

C: The peeled area at a cut intersection or along a cut line ranged from 5% to 35%.

D: The peeled area was larger than C.

<Evaluation of Low-Temperature Fixability>

Drying of the carrier liquid and heat-fixing of the toner were performed in the same manner as in the evaluation of adhesion except that the set temperature of the secondary transfer roller 31 was changed. The fixability was visually evaluated.

Evaluation Criteria for Low-Temperature Fixability

A: Fixable at a temperature of 85° C. or less.

B: Fixable at a temperature of more than 85° C. and 90° C. or less.

C: Fixable at a temperature of more than 90° C. and 100° C. or less.

D: Unfixable at a temperature of 100° C. or less.

<Evaluation of Storage Stability>

A liquid developer in a 9-ml glass sample bottle was left standing in a thermostat at 40° C. for 90 days. After 90 days, precipitated toner particles were redispersed. Whether the particle size measured by the method for measuring the volume-average particle diameter described above could return to the primary particle size (the volume-average particle diameter after the preparation of the developer ±10%) or not was determined according to the following criteria.

Evaluation Criteria for Storage Stability

A: The particle size of precipitated toner returns to the primary particle size by shaking.

B: The particle size of precipitated toner returns to the primary particle size by trituration with a spatula and by ultrasonic dispersion.

C: Precipitated toner cannot be redispersed by trituration.

Table 1 shows the results of these evaluations.

TABLE 1

| | Resin A | | | Resin B | | | | | Evaluation results | | |
|---|---|---|---|---|---|---|---|---|---|---|---|
| | Type | Y2 content of resin A [mass %] | Resin A content of resin component [mass %] | Type | Y3 content of resin B [mass %] | Resin B content of resin component [mass %] | W2/W3 | Carrier liquid | Adhesion | Low-temperature fixability | Storage stability |
| Example 1 | A-1 | 15 | 80 | B-1 | 20 | 20 | 3.0 | Isopar L | A | A | A |
| Example 2 | A-1 | 15 | 80 | B-2 | 20 | 20 | 3.0 | Isopar L | B | A | A |
| Example 3 | A-1 | 15 | 80 | B-3 | 20 | 20 | 3.0 | Isopar L | B | A | A |
| Example 4 | A-1 | 15 | 80 | B-4 | 20 | 20 | 3.0 | Isopar L | B | A | A |
| Example 5 | A-1 | 15 | 80 | B-5 | 20 | 20 | 3.0 | Isopar L | A | A | A |

TABLE 1-continued

| | Resin A | | | Resin B | | | | | Evaluation results | | |
|---|---|---|---|---|---|---|---|---|---|---|---|
| | Type | Y2 content of resin A [mass %] | Resin A content of resin component [mass %] | Type | Y3 content of resin B [mass %] | Resin B content of resin component [mass %] | W2/W3 | Carrier liquid | Adhesion | Low-temperature fixability | Storage stability |
| Example 6 | A-1 | 15 | 80 | B-6 | 20 | 20 | 3.0 | Isopar L | B | B | A |
| Example 7 | A-1 | 15 | 80 | B-7 | 20 | 20 | 3.0 | Isopar L | A | A | A |
| Example 8 | A-1 | 15 | 80 | B-8 | 20 | 20 | 3.0 | Isopar L | A | A | B |
| Example 9 | A-1 | 15 | 80 | B-9 | 20 | 20 | 3.0 | Isopar L | A | A | A |
| Example 10 | A-1 | 15 | 80 | B-10 | 20 | 20 | 3.0 | Isopar L | B | A | A |
| Example 11 | A-2 | 10 | 60 | B-11 | 80 | 40 | 0.19 | Isopar L | A | A | A |
| Example 12 | A-3 | 5 | 60 | B-11 | 80 | 40 | 0.09 | Isopar L | B | A | A |
| Example 13 | A-2 | 10 | 88 | B-1 | 20 | 12 | 3.7 | Isopar L | B | B | A |
| Example 14 | A-1 | 15 | 80 | B-12 | 10 | 20 | 6.0 | Isopar L | B | A | A |
| Example 15 | A-2 | 10 | 97 | B-1 | 20 | 3 | 16.2 | Isopar L | C | C | A |
| Example 16 | A-1 | 15 | 80 | B-13 | 45 | 20 | 1.3 | Isopar L | A | A | A |
| Example 17 | A-1 | 15 | 80 | B-14 | 60 | 20 | 1.0 | Isopar L | A | B | A |
| Example 18 | A-3 | 5 | 80 | B-1 | 20 | 20 | 1.0 | Isopar L | A | A | A |
| Example 19 | A-4 | 2 | 80 | B-1 | 20 | 20 | 0.4 | Isopar L | C | A | A |
| Example 20 | A-5 | 20 | 80 | B-1 | 20 | 20 | 4.0 | Isopar L | A | C | A |
| Example 21 | A-1 | 15 | 80 | B-1 | 20 | 20 | 3.0 | Silicone oil | B | B | A |
| Example 22 | A-1 | 15 | 80 | B-15 | 6 | 20 | 10.0 | Isopar L | B | A | A |
| Example 23 | A-1 | 15 | 55 | B-1 | 20 | 45 | 0.92 | Isopar L | A | A | A |
| Example 24 | A-1 | 15 | 80 | B-16 | 90 | 20 | 0.70 | Isopar L | A | C | A |
| Comparative example 1 | — | — | — | B-1 | 20 | 20 | — | Isopar L | D | B | A |
| Comparative example 2 | — | — | — | B-1 | 20 | 20 | — | Isopar L | A | D | A |
| Comparative example 3 | A-1 | 15 | 80 | B-17 | 3 | 20 | 20.0 | Isopar L | D | A | A |
| Comparative example 4 | A-1 | 15 | 80 | B-18 | 95 | 20 | 0.63 | Isopar L | B | D | A |
| Comparative example 5 | A-1 | 15 | 40 | B-1 | 20 | 60 | 0.50 | Isopar L | B | D | A |
| Comparative example 6 | A-1 | 15 | 99.5 | B-1 | 20 | 0.5 | 149.3 | Isopar L | D | D | A |

The present disclosure can provide a liquid developer that can form a fixed image with good low-temperature fixability and with high adhesiveness to a plastic film medium.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-175900 filed Sep. 26, 2019, which is hereby incorporated by reference herein in its entirety.

What is claimed is:

1. A liquid developer comprising:

toner particles; and a carrier liquid, the toner particles containing a resin component, wherein the resin component includes a resin A and a resin B, the resin A has a unit Y1 represented by formula (1) and a unit Y2 represented by formula (2), the resin B has a unit Y3 represented by formula (3) and at least one unit Y4 selected from the group consisting of units represented by formula (4), units represented by formula (5), units represented by formula (6), units represented by formula (7), and units represented by formula (8), the resin A has a unit Y2 content of 1% to 20% by mass, the resin B has a unit Y3 content of 5% to 90% by mass, the resin component has a resin A content of 50% to 99% by mass, and the resin component has a resin B content of 1% to 50% by mass, (1)

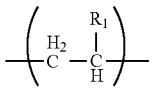

(2)

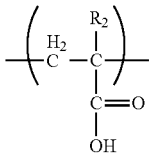

(3)

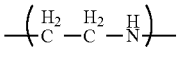

(4)

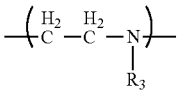

(5)

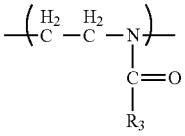

-continued (6)

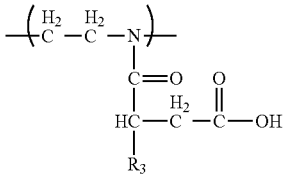

(7)

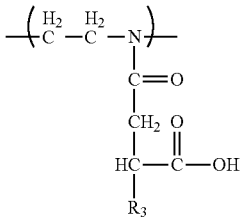

(8)

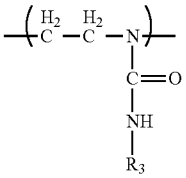

$R_1$ in formula (1) denotes H or $CH_3$, $R_2$ in formula (2) denotes H or $CH_3$, and $R_3$ in formulae (4) to (8) denotes an alkyl group or an alkenyl group.

2. The liquid developer according to claim 1, wherein the carrier liquid is an aliphatic hydrocarbon.

3. The liquid developer according to claim 1, wherein the resin A has a unit Y2 content of 5% to 16% by mass.

4. The liquid developer according to claim 1, wherein the resin B has a unit Y3 content of 5% to 50% by mass.

5. The liquid developer according to claim 1, wherein the resin component has a resin A content of 50% to 95% by mass, and the resin component has a resin B content of 5% to 50% by mass.

6. The liquid developer according to claim 1, wherein the resin component has a resin A content of 50% to 85% by mass, and the resin component has a resin B content of 15% to 50% by mass.

7. The liquid developer according to claim 1, wherein the resin component has a unit Y2 content W2 and a unit Y3 content W3 that satisfy $0.10 \leq W2/W3 \leq 4.0$.

8. The liquid developer according to claim 1, wherein a total amount of unit or units represented by formula (6) and unit or units represented by formula (7) in the unit Y4 ranges from 50% to 100% by mass.

9. The liquid developer according to claim 1, wherein $R_3$ in formulae (4) to (8) denotes an alkyl group having 6 to 22 carbon atoms or an alkenyl group having 6 to 22 carbon atoms.

* * * * *